United States Patent [19]

Chowdhury et al.

[11] Patent Number: 4,977,320

[45] Date of Patent: Dec. 11, 1990

[54] ELECTROSPRAY IONIZATION MASS SPECTROMETER WITH NEW FEATURES

[75] Inventors: Swapan K. Chowdhury; Viswanatham Katta; Brian T. Chait, all of New York, N.Y.

[73] Assignee: The Rockefeller University, New York, N.Y.

[21] Appl. No.: 467,978

[22] Filed: Jan. 22, 1990

[51] Int. Cl.[5] ..... H01J 49/04; H01J 49/10

[52] U.S. Cl. ..... 250/288; 250/281

[58] Field of Search ..... 250/288, 288 A, 281, 250/282; 436/173

[56] References Cited

U.S. PATENT DOCUMENTS 4,209,696 6/1980 Fite ..... 250/288

4,542,293 9/1985 Fenn et al. ..... 250/288

*Primary Examiner*—Jack I. Berman

*Attorney, Agent, or Firm*—Wyatt, Gerber, Burke and Badie

[57] ABSTRACT

An electrospray ion source is designed for ready and simple plugging into commercial mass analyzers for mass spectrometric analysis of organic molecules. The electrospray is carried out is the ambient air and the ions and other charged species enter the mass analyuzer through a long metal capillary tube and three stages of differential pumping. The use of the long tube allows (a) convenient injection of the ions into the mass analyzer (b) optimization of the spray by direct visualization in the air (c) efficient and controlled heat transfer to the droplets and (d) efficient pumping of the region between the capillary exit and the skinner. Desolvation of the solvated ions is carried out using a combination of controlled heat transfer to the charged droplets during the transit through the tube and collisional activation in a region of reduced pressure. Desolvation with this system does not involve use of a strong countercurrent flow of heated gas. The system also may be used to obtain the collisional activated fragmentation spectra of molecule ions. The use of a metal capillary tube avoids complications from charging that arise from the use of dielectric capilliary tubes.

26 Claims, 9 Drawing Sheets

ELECTROSPRAY IONIZATION MASS SPECTROMETER WITH NEW FEATURES

FIELD OF THE INVENTION

The present invention relates to mass spectrometry and more particularly to the production of intact high molecular weight ions by electrospray ionization.

DESCRIPTION OF THE RELATED ART

Mass spectrometry is a widely accepted analytical technique for the accurate determination of molecular weights, the identification of chemical structures, the determination of the composition of mixtures and quantitative elemental analysis. It may accurately determine the molecular weights of organic molecules and determine the structure of the organic molecules based on the fragmentation pattern of the ions formed when the molecule is ionized.

Organic molecules having a molecular weight greater than about a few hundred to few thousand are of great medical and commercial interest as they include, for example, peptides, proteins, DNA, oligosaccharides, commercially important polymers, organometallic compounds and pharmaceuticals.

It has been suggested, in a series of articles cited below, that large organic molecules, of molecular weight over 10,000 Daltons, may be analyzed in a quadrupole mass spectrometer using "electrospray" ionization to introduce the ions into the spectrometer.

In electrospray ionization a syringe needle has its orifice positioned close (0.5–4 cm) to the entrance orifice of a quadrupole mass spectrometer. A dilute solution, containing the molecules of interest, is pumped through the syringe needle. A strong electric potential, typically 3 kV to 6 kV, between the syringe needle orifice and an orifice leading to the mass analyzer forms a spray ("electrospray") of the solution. The electrospray is carried out at atmospheric pressure and provides highly charged droplets of the solution. Ions of the molecule of interest are formed directly from the charged droplets.

The following cited articles are incorporated by reference herein.

It has been suggested by Dole et al, "Molecular Beams of Macroions," *J. Chem. Phys.* 1968, 49, pgs 2240–2249 and Mack et al, "Molecular Beams of Macroions II," *J. Chem Phys.* 1970, 52, pgs 4977–4986 to produce isolated gas phase ions from high molecular weight polymers in solution. These macromolecule ions were produced by electrospraying a polymer solution into a bath gas at atmospheric pressure. The procedure of electrospray used by Dole involved application of a strong electric field between the syringe needle and a counter electrode. When the analyte solution is pumped through the syringe needle, the electric field caused the disintegration of the liquid into a spray of fine charged droplets. Since conventional mass analyzers, available at the time, could not accommodate ions of such high mass, Dole had to resort to a low accuracy, indirect determination of the mass-to-charge ratio of the ionized macromolecules by measuring the retarding potential required to stop them from reaching a Faraday cage.

More recently, Whitehouse et al, "Electrospray Interface for Liquid Chromatographs and Mass Spectrometers," *Anal. Chem.* 1985, 57, pgs 675–679, Meng et al, "Of Protons or Proteins," *Z. Phys. D* 198, 10, pgs 361–368, and Wong et al, *J. Phys. Chem.*, 1988, 92, pg 546–550 overcame the difficulties encountered by Dole by interfacing an atmospheric pressure electrospray ionization source to a quadrupole mass analyzer. They discovered that the electrospray ionization process exhibits a strong propensity for producing very highly charged ions from organic polymers. A practical consequence of the efficient production of these highly charged ion species is that the mass range of the quadrupole analyzer is effectively increased by a factor equal to the number of charges on the polymer ions.

More recently, Loo et al, "Collisional Effects on the Charge Distribution of Ions from Large Molecules Formed by Electrospray-Ionization Mass Spectrometry," *Rapid Commun. Mass Spectrom.* 1988, 2, pgs 207–210, also used electrospray ionization with a quadrupole mass analyzer to obtain accurate molecular masses of a variety of proteins that were not previously measurable by mass spectrometry.

Since electrospray ionization occurs directly from solution at atmospheric pressure, the ions formed in this process tend to be strongly solvated. To carry out meaningful mass measurements, it is necessary that any solvent molecules attached to the ions be efficiently removed. In the instruments mentioned in the above articles, desolvation is achieved by interacting the droplets and solvated ions with a strong countercurrent flow (6–9 l/m) of a heated gas, before the ions enter into the vacuum of the mass analyzer.

The use of such a strong counter current gas flow is expensive and difficult to operate because the gas flow rate and the temperature need to be controlled precisely and be optimized for each analyte and solvent system. If proper gas flow and temperature conditions are not attained, it can result in either an incomplete desolvation of the ions or decrease in sensitivity as ions may be swept away by the gas at high flow rate. To enhance the desolvation process, Loo et al also used collisional activation by applying an electrostatic field in a region of reduced pressure between the sampling orifice of the mass analyzer and the skimmer.

Although high speed pumping is incorporated in all the above instruments to allow for the direct sampling of electrosprayed ions into the mass analyzer, the detailed method of ion transport from atmospheric pressure to vacuum is different in each case. Thus ion transport has been achieved through a 0.2 mm bore 60 mm long glass capillary tube and skimmer (Whitehouse et. al) and a 1.0 mm diameter sampling orifice and skimmer (Loo et al).

OBJECTIVES OF THE INVENTION

It is an objective of the present invention to provide an electrospray ion source for a mass spectrometer which does not use a counterflow of gas in the system, as such gas flow is difficult to adjust and control.

It is a further objective of the present invention to provide such an ion source which will fit on commercial mass analyzers with only minor modifications.

It is a further objective of the present invention to provide such an ion source which will produce an adequate supply of highly charged ions from macromolecules without fragmentation of the ions.

It is further objective of the present invention to provide such an ion source in which a solution of micron size droplets is sprayed into the atmosphere outside of the vacuum of the mass spectrometer so that the user may readily view and adjust the spray.

It is a further objective of the present invention to provide such an ion source in which the desolvation and fragmentation of analyte molecule ions can be conveniently and precisely controlled.

It is a further objective of the present invention to provide convenient injection of electrospray produced ions from atmospheric pressure to the vacuum of the mass analyzer.

It is a further objective of the present invention to provide such an ion source that would, before entering the mass analyzer, allow structural elucidation of biomolecules by collisional activated fragmentation of the intact molecule ions from samples.

SUMMARY OF THE INVENTION

In accordance with the present invention a modified mass analyzer is connected to a novel electrospray ion source to form a mass spectrometer. The mass analyzer may be a quadrupole, a magnetic deflection, TOF (time-of-flight), Fourier Transform or other type of mass analyzer.

The ion source includes a syringe needle (0.15 mm id.) having a high voltage (4–6 KV) imposed upon it whose exit orifice is spaced in ambient atmosphere of the laboratory at a distance (0.5–4 cm) from the entrance orifice of a long metal capillary tube. The capillary tube is heated (80°–90° C.) by an electrical resistance coil and held at a lower voltage (0–400 V). The exit orifice of the capillary tube is separated from a skimmer and is within a vacuum chamber (pressure 1–10 Torr). A hole (0.5 mm dia.) in the skimmer leads to a second vacuum chamber ($4\times10^{-4}$ Torr), to a series of lenses, each with a hole therethrough, and to a baffle having a hole (2.4 mm dia.) therethrough and leading to the vacuum chamber ($2\times10^{-5}$ Torr) of the mass analyzer (quadrupole analyzer).

The molecules of interest, for example a protein, is dissolved in a solvent or mixture of solvents and the solution is pumped through the syringe needle. The solution is electrosprayed therefrom in micron size droplets into the atmosphere so it may be viewed and adjusted by the user. The electric field in the gap between the electrospray syringe needle and the capillary tube causes the formation of charged droplets that enter the capillary tube. The strong flow of gas in the capillary tube as a result of pressure difference between the ends of the tube causes the charged droplets to progress down the center of the tube. Heating of the capillary tube causes evaporation of the droplets and desolvation of the resulting molecule ions of interest. For example, the capillary tube may be heated by an electrical resistance wire wound about the tube or the tube may be a resistive heating element.

The ions exit into a vacuum chamber where solvent is further removed by collisional activation and then the charged ions pass through the hole in the skimmer, through the holes in the lenses and baffle and into the analyzer.

BRIEF DESCRIPTION OF THE DRAWINGS

Other objectives and features of the present invention will be apparent from the following detailed description of the present invention, taken in conjunction with the accompanying drawings.

In the drawings.

Detailed Description of the Invention

Figure 1:
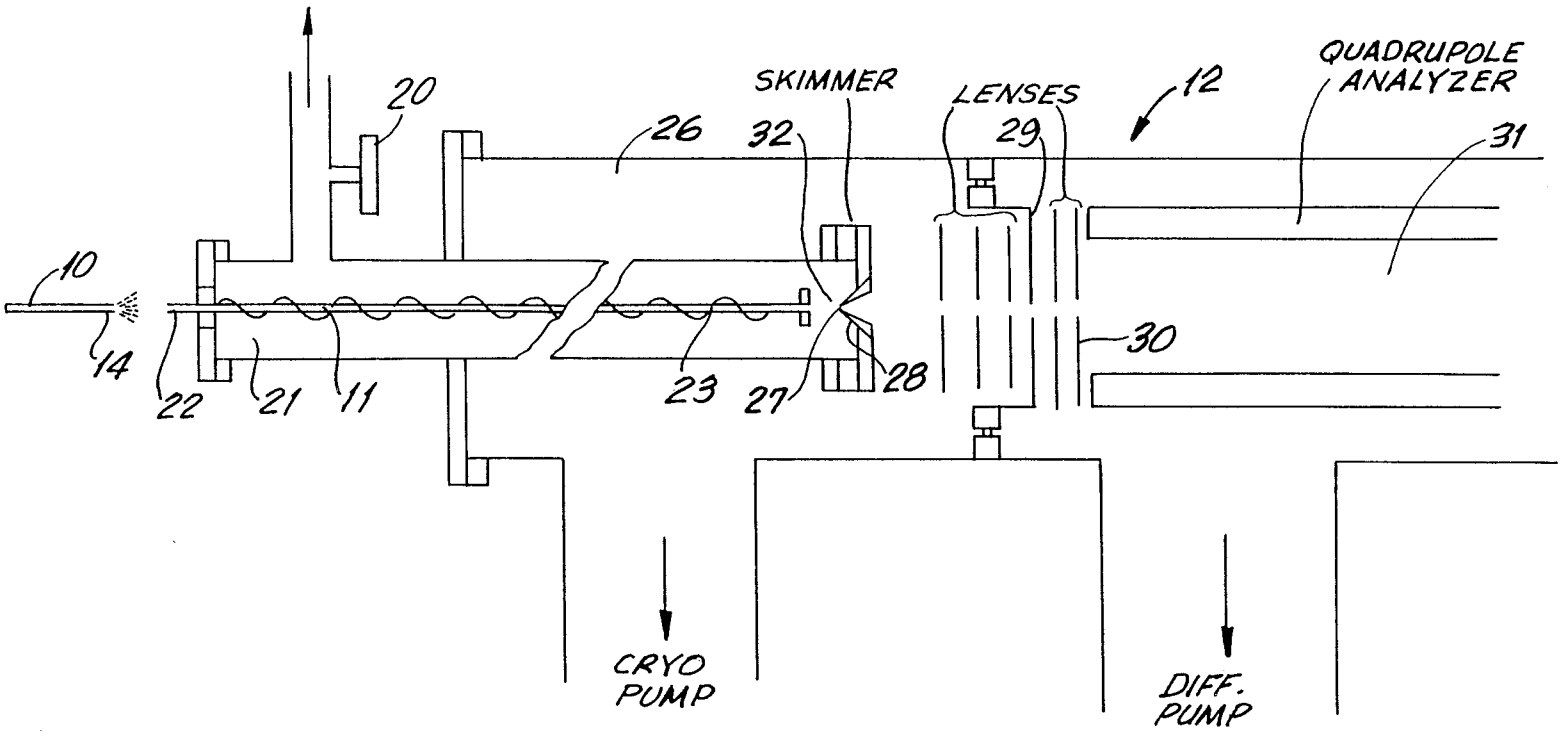
FIG. 1 is a side plan view schematic diagram of the electrospray ionization mass spectrometer (not drawn to scale) of the present invention.

A schematic representation of the electrospray ionization mass spectrometer of the present invention is shown in FIG. 1. The mass spectrometer uses a newly designed electrospray ion source that is plugged directly into a modified commercial quadrupole mass analyzer with the ions entering the mass analyzer through a long capillary tube and three stages of differential pumping.

The analyte solution is a dilute solution of the molecules of interest in a suitable solvent. That solution is electrosprayed from a syringe needle which is a 90° point stainless steel needle (0.15 mm i.d.). The needle 10 is maintained at 3 to 6 kV relative to a metal capillary tube 11 through which droplets, ions, and gases enter into the mass analyzer. A syringe pump (preferably Sage Instrument Model 341B) maintains a constant rate of flow through the needle 10 of 0.5–2 ul/min. The gap between the electrospray needle tip 14 and the capillary tube 11 is preferably 1 cm and is in the range of 0.5–4 cm.

The quality of the mass spectrum is strongly dependent on the quality of the spray emitting from the needle, i.e., on its fineness and consistency. In the present design, the spray can be seen by the user and can be rapidly optimized by direct visualization, outside the vacuum housing, and by monitoring the current emitted from the needle.

Electrospray of the analyte solution produces fine, highly charged droplets. These droplets attempt to follow the electric field lines and migrate towards the metal capillary tube 11. The tube 11 is preferably of 1.59 mm o.d., 0.50 mm i.d., 203 mm length and projects into the first vacuum chamber 21 of the mass spectrometer. The whole vacuum housing 12 is heated to a temperature of about 100° C. The first vacuum chamber 21 is evacuated by a rotary pump, preferably Edwards ISC 900, pumping speed of 1100 l/min to maintain a pressure of 1.2 torr at the position of the pirani gauge 20 shown in FIG. 1. A fraction of the migrating droplets enter the long stainless steel capillary tube 11 assisted by the strong flow of gas that results from the large pressure difference between the two ends of the tube 11.

Droplets entering into the input orifice 22 of the tube 11 tend to be focused towards the center of the tube 11 by this strong gas flow and are thus transported through the tube.

The tube 11 is heated to preferably about 85° ±5° C. (range of 25°-200° C.). The heat causes the ionized droplets and solvated ions to undergo continuous desolvation as they pass through the tube 11. The long metal capillary tube 11 transports ionized entities from atmospheric pressure to a chamber 21 of reduced pressure (1-10 torr). The long tube 11 allows (a) convenient injection of ions into the commercial mass spectrometer system; (b) efficient pumping of the region between the capillary tube exit and the skimmer; (c) ready visualization of the electrosprayed droplets by the user as they emit from the needle so that adjustments may be made; and (d) efficient and controlled heat transfer to the droplets. The use of metal, in the present design, reduces charging problems sometimes encountered with glass capillary tubes.

A fraction of the material that emerges from the capillary tube 11 passes into a second vacuum chamber 26 and through a preferably 0.5 mm diameter orifice 27 in a skimmer 28 preferably situated 3.3 mm from the end of the tube 11. The tube 11 and skimmer 28 are electrically isolated to allow the application of an electric field in the region between them. Most of the remaining solvent molecules that adhere to the biomolecule ions of interest are removed by collisional activation before they reach the skimmer 28 induced by this tube-skimmer electrostatic field. The second vacuum chamber 26 is differentially pumped by a He-cryogenic pump, preferably Air Products, model AP-6, having a pumping speed of 680 l/s for $N_2$ to give a vacuum of $4\times10^{-4}$ torr. The ions that emerge from the skimmer 28 are focused by a set of lenses into the mass analyzing chamber 31 through a 2.4 mm diameter hole in a baffle 29 that separates this second vacuum chamber 26 from the mass analyzer chamber 31. Beyond the baffle 29, the ions pass through another set of lenses 30 and enter the mass analyzer, preferably a quadrupole analyzer, where their mass-to-charge ratios (m/z) are determined. The vacuum in the analyzer chamber 31 is held at $2\times10^{-5}$ torr by an oil diffusion pump, preferably Edwards diffstak-63M, pumping speed of 155 l/s. Following m/Z analysis, ions are post-accelerated by a potential of between −2200 and −3000 V and are detected by an off-axis electron multiplier.

The combination of controlled heat transfer to the charged droplets during transport through the long capillary tube 11 and collisional activation caused by an electrostatic field 32 in a region of reduced pressure brings about the removal of solvent molecules adhering to the biomolecule ions. This electrostatic field 32 is easily variable and provides a sufficiently fine control of the collisonal activation so that at low fields complete desolvation of the molecule ions can be effected without fragmentation, while at high fields dissociation can be effected to give collisional activated dissociation spectra. Desolvation with this system is convenient and effective and does not involve the strong countercurrent flow of gases that have been employed in the above-cited articles.

The quadrupole mass analyzer, vacuum housing, detector, and all lens elements beyond the skimmer may be conventional mass spectrometer components; for example, they may be components of a standard Vestec model 201 thermospray mass spectrometer available from Vestec Corp., Houston, Tex. The m/z range of the quadrupole system was extended to 2000 by reduction of the radio frequency applied to the rods.

The typical and preferred operating voltages are as follows: syringe needle (+5 kV), metal capillary tube (+250 V), skimmer (+18 V), and baffle (0 V). All external flanges and the vacuum housing 12 are at 0 V.

The spectra, set forth in the drawings and examples herein, were acquired using a commercial data system (Vector-1, Tekivent, St. Louis, Mo.) on an IBM-AT compatible computer (Dell-310, 80366/20 MHz) by scanning through the m/z range of interest (typically 1000 ) over periods of 1-4 minutes. In some cases, multiple scans were added together and averaged to obtain higher signal-to-noise ratios. It should be noted, however, that this data system records ion abundances at integer m/z values and thus produces data of limited accuracy. In order to obtain accurate m/z values, the centroids of the peaks of interest are determined by scanning the mass spectrometer through a narrow range of m/z values (typically 2-20) in the so-called "calibration mode". This latter procedure normally required approximately 30 sec for each peak. The mass spectrometer was calibrated with the intense series of multiply charged ions generated from equine apomyoglobin, ranging from m/z 848.53 for the $(M+20\ H)^{20+}$ ion to m/z 1304.88 for the $(M+13\ H)^{13+}$ ion, and the doubly protonated molecule ion of bradykinin at m/z 531.10.

In the following examples, all the peptides and proteins were obtained from Sigma Chemical Co., St. Louis, Mo., with the exception of human apolipoprotein Al, which was provided by Drs. J. Breslow, E. Brinton and Y. Ito of Rockefeller University. The proteins, their origin and the catalog number are respectively: albumin (bovine serum, A-6793), bradykinin (B-3259), carbonic anhydrase II (bovine erythrocyte, C-6403), conalbumin (turkey egg, C-3890), cytochrome C (horse heart, C-3256), insulin (bovine pancreas, I-5500), β-lactoglobulin (bovine milk, L-5137), lysozyme (chicken egg, L-6876), myoglobin (equine skeletal muscle, M-9267), ribonuclease A (bovine pancreas, R-4875), subtilisin BPN' (bacillus amyloliquefaciens, P-5255), and trypsin inhibitor (soybean, T-1021). The proteins were dissolved in a solvent mixture of water, methanol, and acetic acid in the ratio of 47:47:6, v/v to form a dilute solution.

DESOLVATION OF IONS

Charged droplets generated at the electrospray needle pass through a 1 cm space, filled with the ambient atmosphere, en route to the sampling capillary tube (FIG. 1). Solvent(s) continuously evaporate from the droplets during this transit. There is no countercurrent flow of gas to assist desolvation in this region. Instead, the whole length of the 203 mm long metal capillary tube is heated to effect a controlled evaporation of solvent(s) from the droplets. The remaining solvent molecules, bound to the ions of interest, are then removed by collisional activation in the space between the point of exit from the capillary tube (exit orifice) and the entrance to the skimmer as a result of an electrostatic field applied to this region of reduced pressure.

Figures 2A, 2B, 2C:
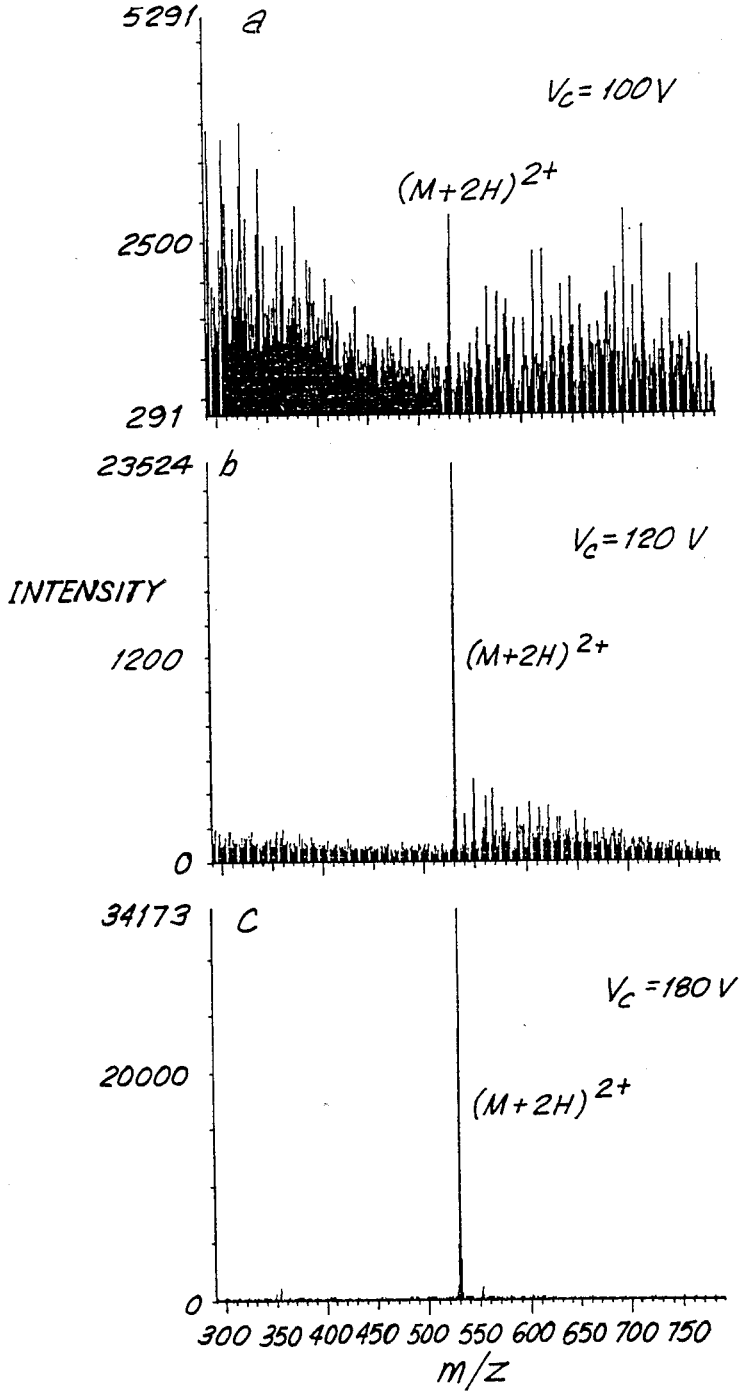
FIG. 2 is an electrospray ionization mass spectra of bradykinin measured at different voltages ($V_c$) applied to the capillary tube in the system of the present invention.

The process of collision induced desolvation of ions is demonstrated in FIG. 2. The tube is kept at a temperature of 85° C. and the skimmer is operated at 17.5 V, while the voltage on the capillary tube $V_c$, is varied from 100 V-300 V. Shown in FIG. 2(*a*) is the electrospray ionization mass spectrum of bradykinin, obtained at $V_c=100$ V. The intensity of the doubly protonated ion, $(M+2\ H)^{2+}$, is small and the presence of a large number of cluster ions is observed. These cluster species are mainly $(M+nH_2O+2H)^{2+}$ with n extending to greater than 28. When $V_c$ is increased to 120 V (FIG. 2(*b*), The $(M+2H)^{2+}$ ion intensity increased by a factor of 4.5 and the maximum of the cluster ion intensity shifts downwards to n=3 or 4. At $V_c$=180 V (FIG. 2(*c*)), almost all the cluster ions have disappeared and a further enhancement of the $(M+2H)^{2+}$ ion is obtained. The enhancement in intensity is such that the multiplier voltage in 2*c* was reduced from −3000 to −2400 V to prevent saturation of the electronics. The present findings concerning collision induced desolvation are in agreement with the earlier observations of Loo et al, cited above, who, however, used a strong countercurrent flow of hot gas to enhance desolvation. As mentioned above, no such gas flow was used in the present invention. Instead, regulation of the temperature of the 203 mm long capillary tube provides a fine control of the desolvation of the droplets passing through it.

The intensity of the peptide ions of interest is found to maximize at a capillary tube temperature of 85° C. We assume, at this temperature, the rate of solvent evaporation from the charged droplets is such as to produce entities large enough for relatively efficient transport through the long tube and at the same time the droplets are desolvated sufficiently upon exiting the tube to allow the remaining solvent molecules to be completely removed by collisional activation, as discussed above. Below 80° C., the intensity of peptide ions decreases rapidly. We ascribe this decrease to insufficient desolvation of the ions. Above 90° C., the intensity also decreases, but relatively slowly. We ascribe this latter decrease to relatively less efficient transport of the resulting smaller ionized entities through the long tube. Consequently, the preferred temperature range is 80°-90° C.

For all organic molecules investigated, the capillary tube was maintained at a constant temperature (85° C.). It proved necessary, however, to adjust the voltage $V_c$, on the capillary tube in order to maximize the response from each different protein. For the majority of the proteins, the optimum value of $V_c$ was found to be 250±10 V. The optimum value of $V_c$ was outside this range for β-lactoglobulin ($V_c$=272 V); carbonic anhydrase II ($V_c$=160 V); ribonuclease A ($V_c$=300 V); and myoglobin ($V_c$=201 V). We ascribe these different values of $V_c$ to the different energies required for complete desolvation of these protein ions. Consequently, the preferred voltage range for $V_c$ is 160 V-300 V and the most preferred for many proteins is 240 V-260 V.

MASS SPECTRA OF PROTEINS

The instrument described above was used to investigate thirteen different proteins with molecular masses ranging from 5,000 to 77,000 μ. The performance of the instrument is illustrated by the spectra shown in FIGS. 3-6 and the data given in Table 1.

Figure 3:
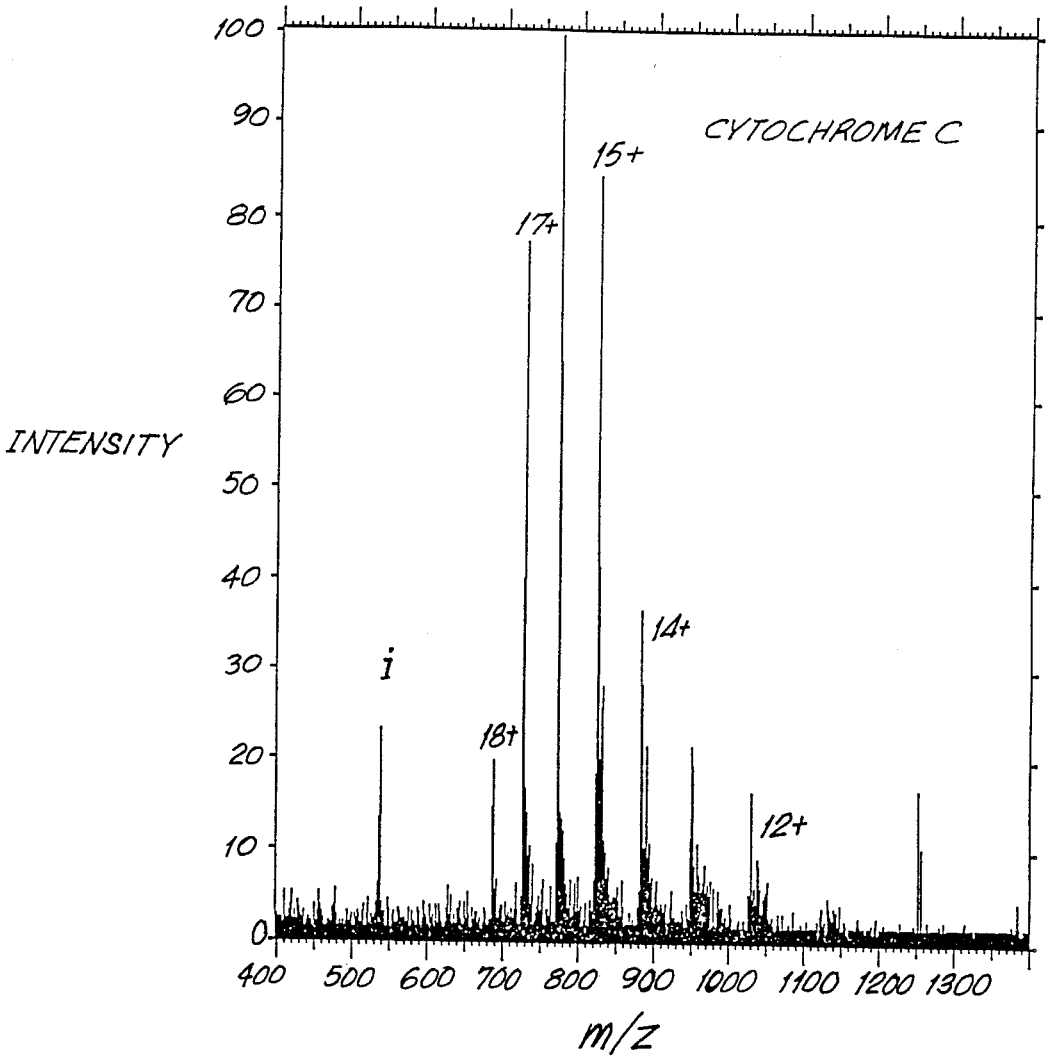
FIG. 3 is an electrospray ionization mass spectrum of cytochrome C obtained from a solution of methanol, water and acetic acid (47:47:6 v/v)

FIG. 3 shows the electrospray ionization mass spectrum of horse heart cytochrome C (molecular mass (MM)=12360.9 μ) between m/z 400 and 1400. The spectrum is the result of a single scan acquired in 125 sec from a solution of cytochrome C (1.6 pmol/μl) dissolved in water, methanol, and acetic acid (47:47:6, v/v), and electrosprayed at a rate of 0.5 l/min. Thus, 1.6 pmol of the sample was consumed in acquiring this spectrum. The voltage $V_c$ was 242 V and V (skimmer) was 19 V. The spectrum exhibits the gaussian distribution of multiply charged ion peaks characteristic of electrospray ionization, resulting from the attachment to cytochrome C of 11-18 protons. Each of these ions provides an independent determination of the molecular mass of the protein. The maximum number of charges ($Z_{max}$) acquired by cytochrome C is observed to be 18 (FIG. 3), despite the fact that the total number of basic sites (sum of the number of Arg, Lys, and His residues plus the amino terminus) present in the protein is 25. The observed $Z_{max}$ for the majority of the other proteins is also lower than the total number of basic sites present in the molecule. This finding, which has been previously noted by others, is especially evident in proteins containing intact disulfide bonds and/or a large number of basic residues that occur in groups. In FIG. 3 the peak labeled i arises from an unidentified impurity.

Figure 4:
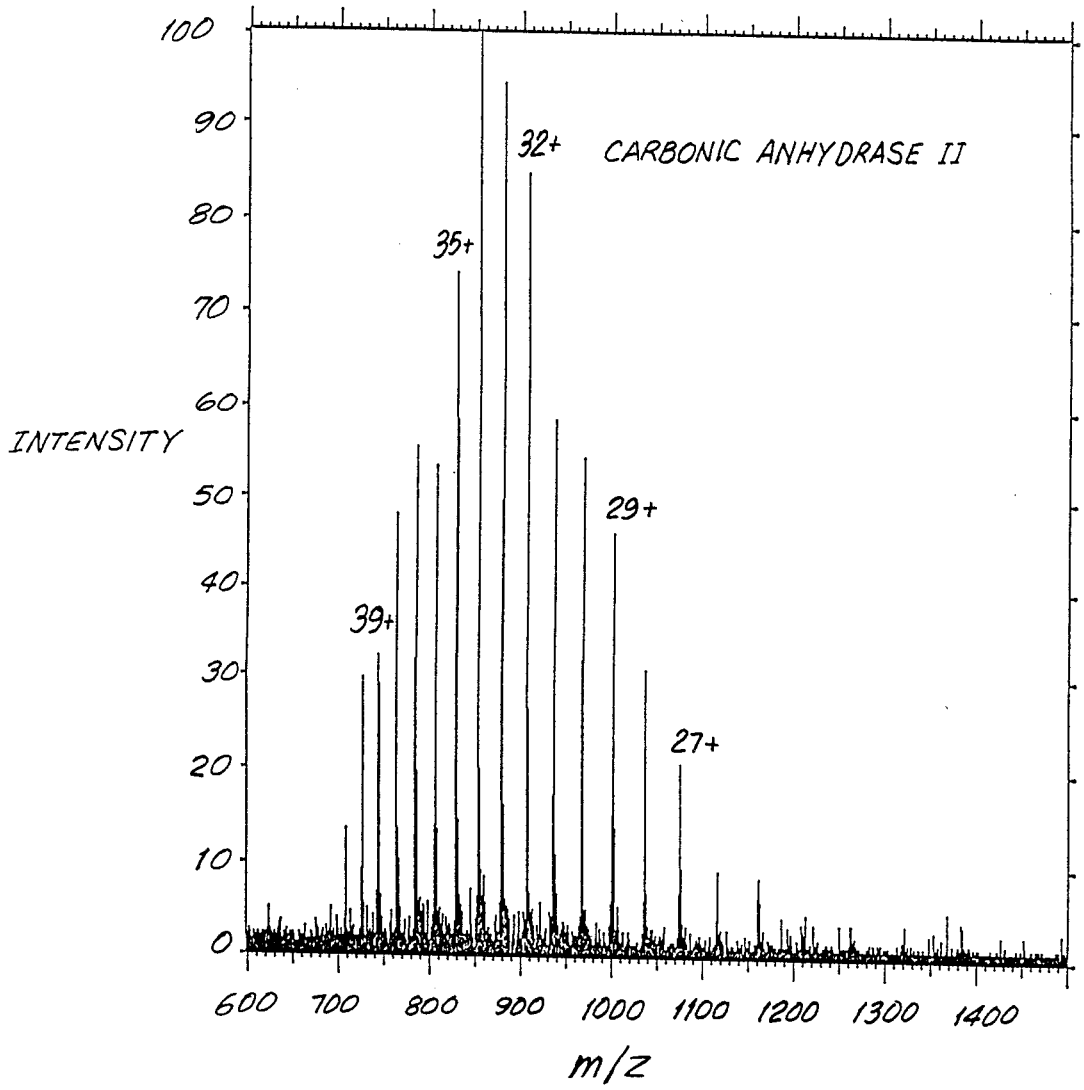
FIG. 4 is an electrospray ionization mass spectrum of bovine carbonic anhydrase II dissolved in a mixture of water, methanol and acetic acid (47:47:6 v/v)

An exception to the above general observation is illustrated in FIG. 4, which shows the mass spectrum of bovine carbonic anhydrase II (MM=29021.3 μ) between m/z 600 and 1500. The bovine carbonic anhydrase II was dissolved in a mixture of water, methanol and acetic acid (47:47:6 v/v) at a concentration of 10.0 p mol/μl and the solution was electrosprayed at a a flow rate of 0.6 μl/min. The single scan spectrum was acquired in 3.5 min. The amount of sample consumed was 21 pmol. In this case, $Z_{max}$=41 is greater than the total number of basic sites present in the molecule, i.e., 39. The high value of $Z_{max}$ is probably the consequence of the absence of disulfide linkages, presence of relatively few clusters of basic amino acid residues, and the use of a low desolvation potential ($V_c$ of 160 V and V (skimmer) of 17 V).

Figure 5:
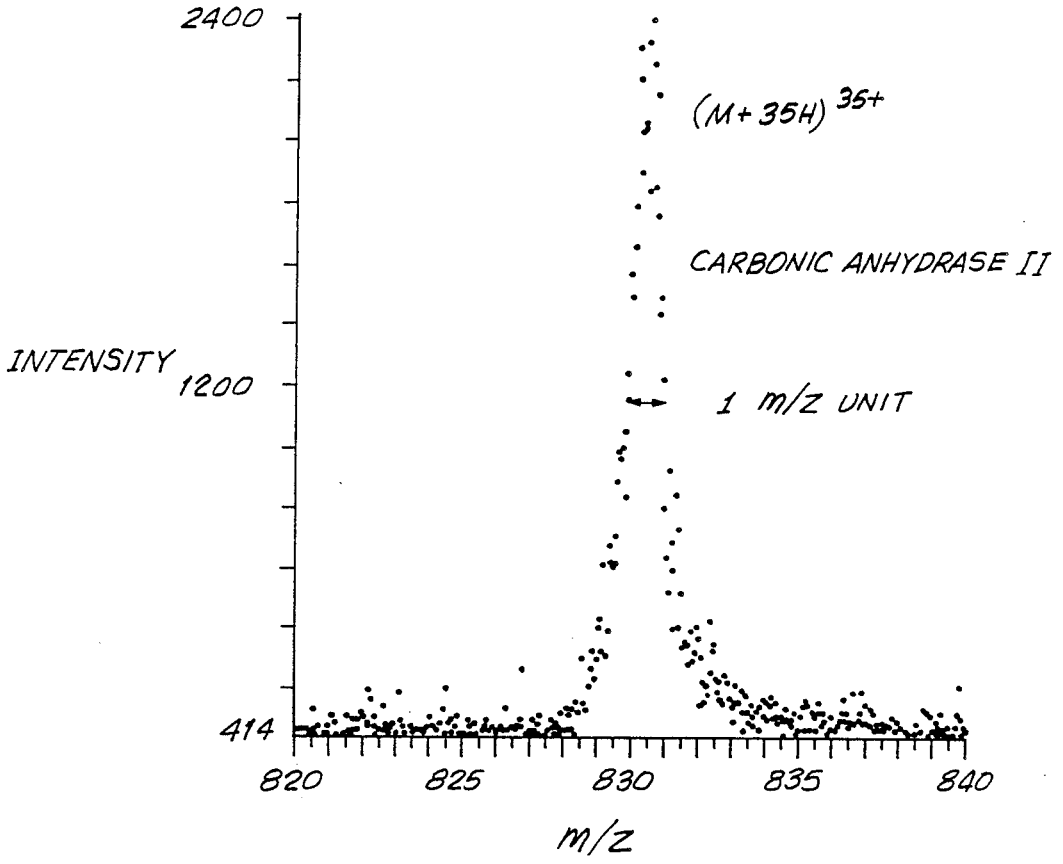
FIG. 5 is a detailed mass spectrum of bovine carbonic anhydrase II in the vicinity of the $(M+35H)^{35+}$ ion.
Figure 6:
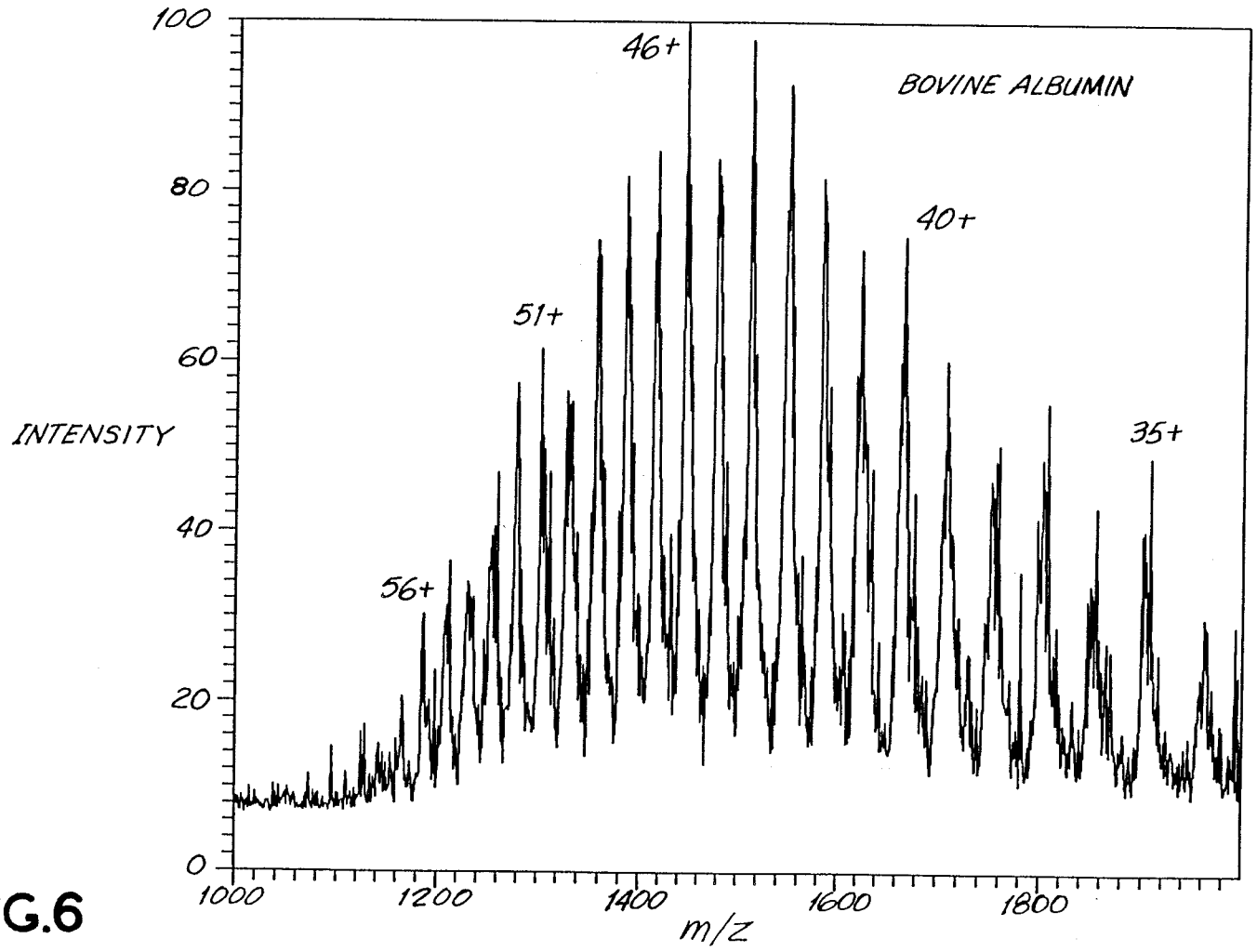
FIG. 6 is a electrospray ionization mass spectrum of bovine serum albumin in which the spectrum is an average of 7 scans (130 sec/scan)

The quality of the data obtained with the present instrument can be assessed by inspection of an expanded portion of the mass spectrum of carbonic anhydrase II. FIG. 5 shows the region of the mass spectrum between m/z 820 and 840 containing the $(M+35H)^{35+}$ ion. The observed peak is quite symmetrical and has a peak width at half maximum of 1 m/z unit, which is the typical resolution used, except in those cases where the mass spectral response is weak. The mass spectrum of bovine albumin shown in FIG. 6 represents an example of a protein exhibiting a very weak mass spectrometric response. The spectrum is an average of 7 scans each of 130 seconds. The other experimental parameters in FIG. 6 were: $V_c$ of 258 V; V (skimmer) of 40 V; concentration of 10 pmol/μl flow rate of 0.5 μl/min. The sample consumed was 76 pmol. Under identical operating conditions, the signal-to-noise ratio was observed to be considerably lower than that for cytochrome C or carbonic anhydrase II. In order to increase the ion intensity, the acceleration potential was therefore increased from ca. 17 V to 40 V, resulting in a decrease in mass resolution. The observed weak response can be attributed to: (a) the formation of a very wide distribution of charge states resulting in a decreased intensity in any given charge state; (b) the lower transmission efficiency and detection efficiency for the higher m/z ions; and (c) other less well understood factors such as sample heterogeneity and incomplete desolvation.

MOLECULAR MASS DETERMINATION

The calculation of molecular masses of proteins from the measured m/z values of multiply charged ions observed in electrospray ionization spectra has been described previously in the above-cited references. The experimentally determined molecular masses of the proteins studied are given in Table 1 together with the corresponding calculated values, the difference between the observed and calculated masses, and the relative sensitivities. The calculated molecular masses were obtained using the sequences compiled in the Dayhoff Protein Sequence Database and currently accepted IUPAC values for the isotopically averaged atomic masses.

An illustration of the accuracy and precision obtained from a protein exhibiting a good response is provided in Table 2, which gives the molecular masses derived from the experimentally observed m/z values of the nine most intense multiply protonated ions of human apolipoprotein Al. The precision of these nine separate determinations is high as evident from the observed stadard deviation of 0.8 u. The accuracy is also high; the mean measured molecular mass of 28078.1 u is in close agreement with the calculated value of 28078.6 u. The measured molecular masses of most of the other proteins studied also agree with the calculated values to within ca. 200 ppm. (Table 1). Two notable exceptions are the masses obtained for subtilisin BPN' from *bacillus amyloliquefaciens* and bovine albumin. The sources of these discrepancies have not yet been elucidated.

The different proteins studied were found to give widely different mass spectrometric responses. The resulting sensitivities are compared in the fifth column of Table 1. In general, proteins containing internal disulfide linkages yielded lower responses than those without crosslinks.

Figure 7:
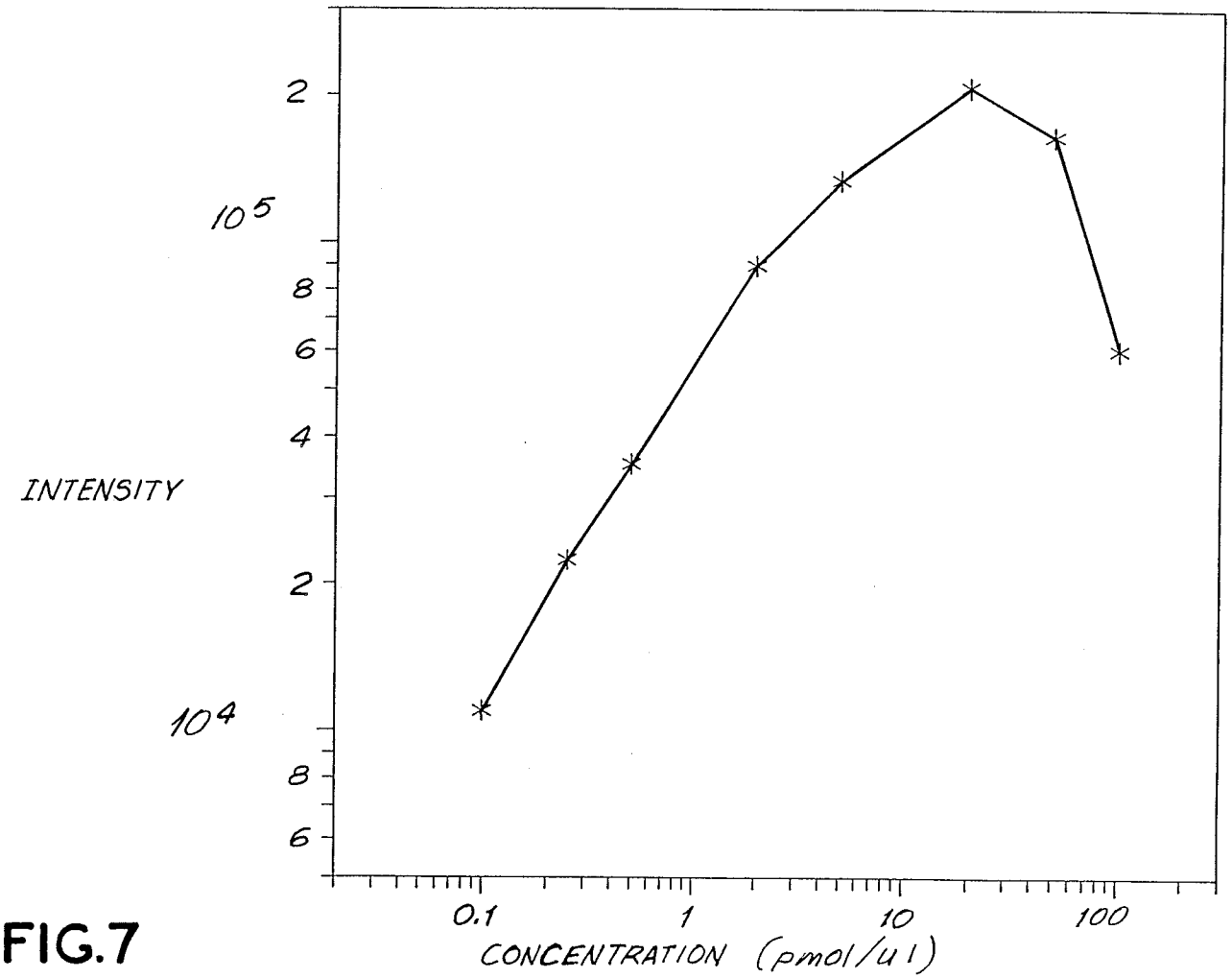
FIG. 7 is a plot of the sum of the intensities of the four most intense ions in the mass spectrum of equine apomyglobin $[(M+17H)^{17+}$, $(M+18H)^{18+}$, $(M+19H)^{19+}$, and $(M+20H)^{20+}]$ as a function of the electrospray solution concentration.

The mass spectrometric response as a function of protein concentration in the electrospray solution has also been investigated. FIG. 7 shows a plot of the sum of the intensities of the four most intense ions in the mass spectrum of equine apomyoglobin as a function of the electrospray solution concentration. The response increases, approximately linearly, as a function of the concentration between 0.1 pmol/ul and 20 pmol/ul, where the intensity is at a maximum. Above 20 pmol/ul, the response drops rapidly with a further increase in concentration. The decrease in intensity may be a consequence of an increase in competition for the limited available charge on the droplets at these higher protein concentrations.

The electrospray ionization source of the present invention provides a simple and inexpensive means for obtaining collisional activated dissociation (CID) spectra, which are useful in structural elucidation, even with a single quadrupole mass analyzer. The electrostatic field between the capillary tube exit orifice and the skimmer is preferably variable and provides a sufficiently fine control of the collisional activation that at low fields complete desolvation of the molecule ions can be effected without fragmentation. With high fields in this region the activation is such that the molecule ion fragments and the fragment ions are efficiently focused into the skimmer orifice 27, thus providing the CID spectra.

Figure 8:
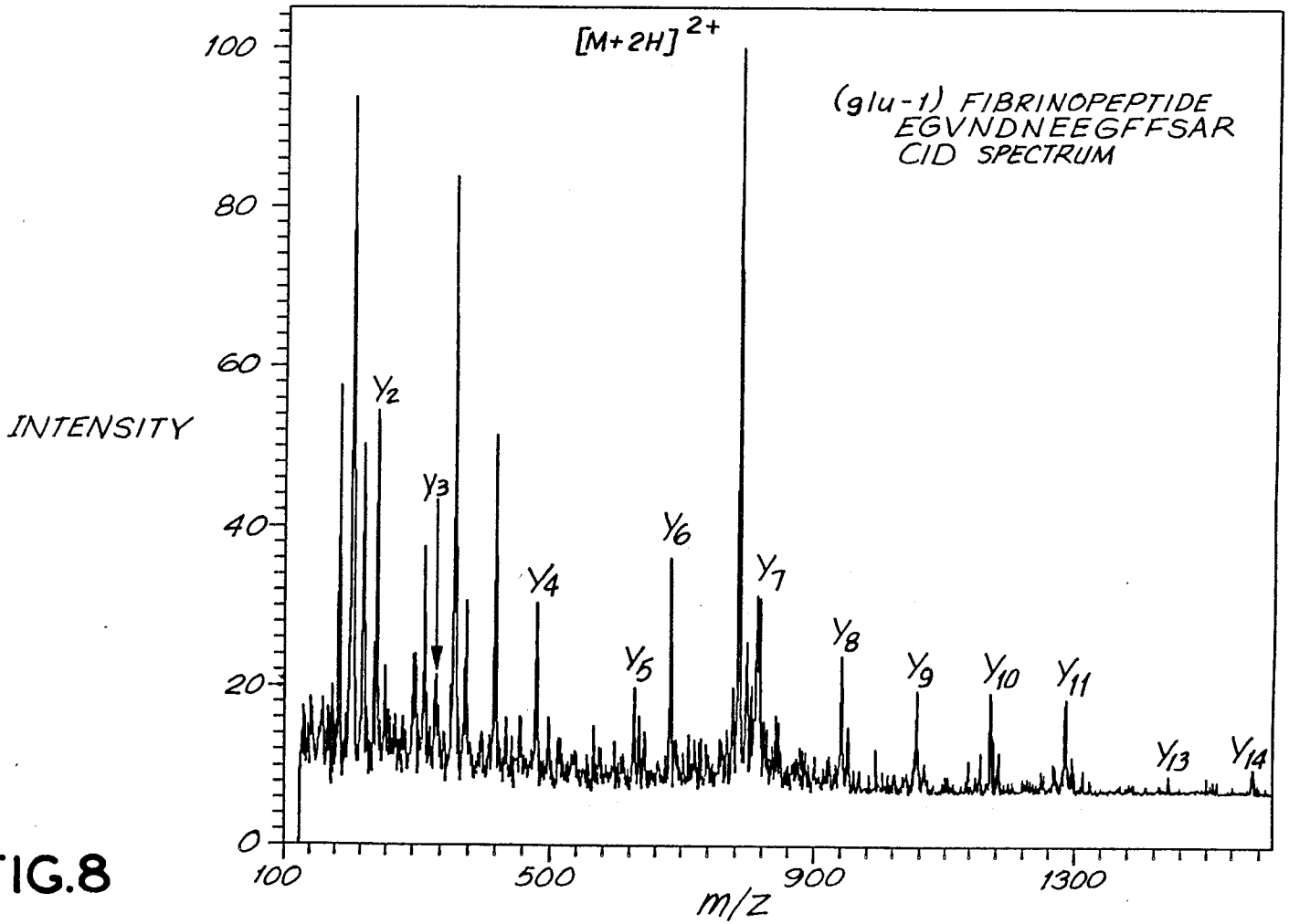
FIG. 8 is an electrospray ionization mass spectrum of (glu-1) fibrinopeptide (CID spectrum)

The CID spectra obtained from a number of peptides using this single quadrupole configuration are comparable in quality and information content to those obtained with more elaborate triple quadrupole instruments. Doubly charged peptide ions, especially from tryptic peptides, yield readily interpretable b and/or y series fragment ions. FIG. 8 shows a CID spectrum obtained in this way from (glu-1) fibrinopeptide, a tetradecapeptide. Complete singly charged y series ions (except $y_1$ and $y_{12}$) can be easily identified in this spectrum, thus giving information about the peptide sequence. Tryptic peptides containing a histidine residue often give a triply protonated molecule ion in addition to the doubly charged species. The collisional activation of these peptides yields a considerably more complex fragmentation because both singly and doubly charged b and/or y series fragment ions are produced. Thus, the present ion source and single quadrupole configuration provides a simple, easy to operate and inexpensive means for obtaining structural information from pure samples.

Figure 9:
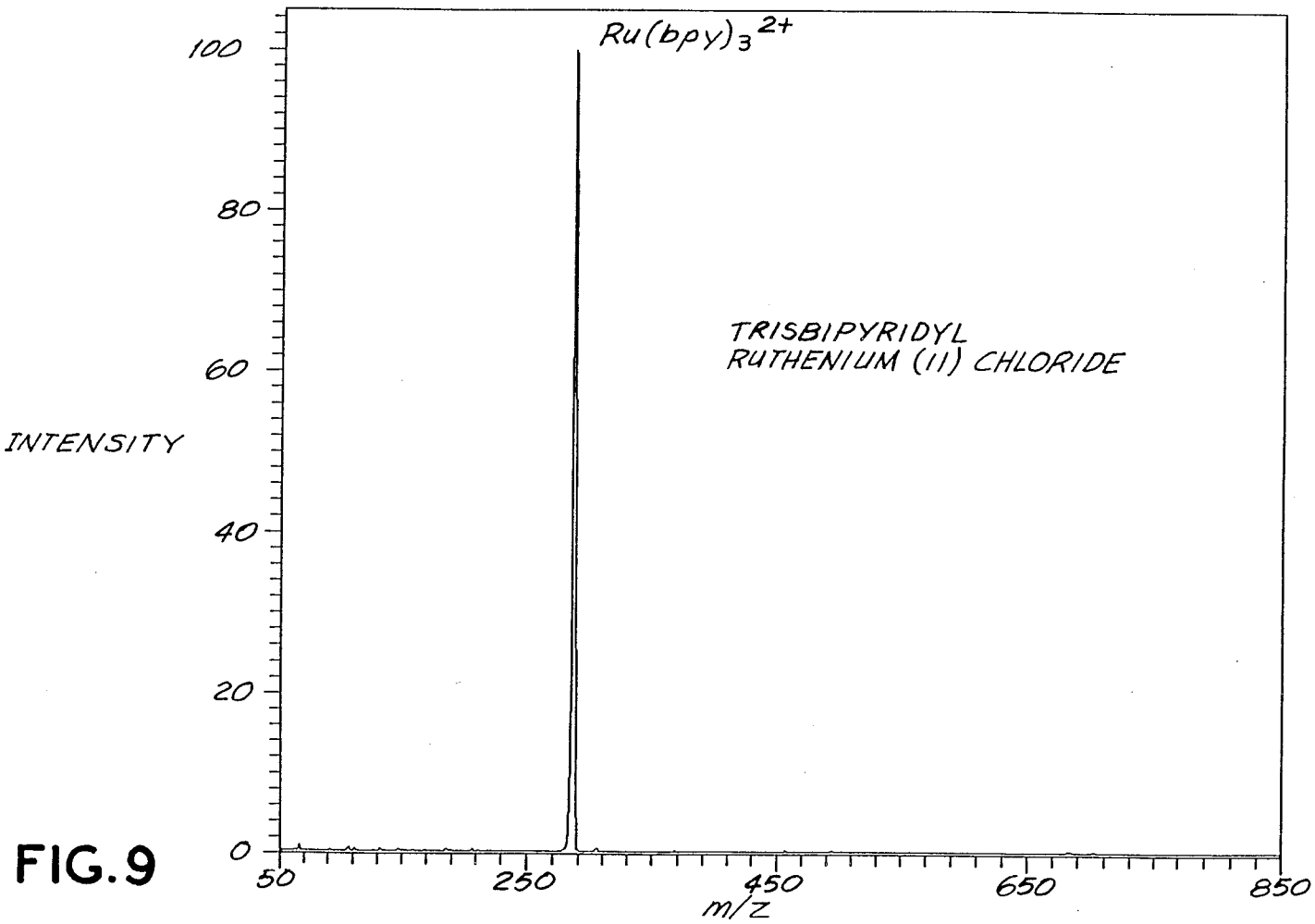
FIG. 9 is an electrospray ionization mass spectrum of trisbipyidyl ruthenium (II) chloride.

Ionic organometallic complexes are of great interest because of their use as catalysts, but so far have been difficult to analyze by mass spectrometry because of their low volatility, thermal lability, and their tendency to undergo reduction during the ionization process. Using the present electrospray ion source there has been generated intact multiply charged gas-phase quasimolecular ions in large numbers, from such organometallic complexes. The extreme softness and sensitivity of the technique for these complexes is evident spectrum shown in FIG. 9 obtained from trisbipyridyl ruthenium (II) chloride, $Ru(II)(bpy)_3Cl_2$. A 20 pmol/ul solution in acetonitrile was electrosprayed at a rate of 1–2 ul/min. At lower collisional activation the doubly charged $Ru(bpy)_3^{2+}$ ions solvated to various extents were observed. When the activation is just sufficient for complete desolvation, the entire mass spectrum (shown in FIG. 9) contains only one intense group of ions at m/z 285 corresponding to the doubly charged $Ru(bpy)_3^{2+}$ ion. There is essentially no fragmentation or reduction. However, upon increasing the activation further, the doubly charged ion dissociates and fragment ions corresponding to the loss of one, two and three bipyridyl groups appear in the spectrum. The present ion source provides a powerful new tool for the analysis of organometallic complexes. It provides a means for producing intense beams of multiply charged organometallic ions, either bare or solvated, for gas-phase ion chemical and spectroscopic studies.

TABLE 1

COMPARISON OF EXPERIMENTALLY OBSERVED AND CALCULATED MOLECULAR MASSES (MM) OF THE THIRTEEN PROTEINS INVESTIGATED

| Protein | Observed MM | Calculated[a] MM | Δ[b] ppm | Sensitivity[c] |
|---|---|---|---|---|
| insulin (bovine) | 5,734.2 ± 0.9[d] | 5,733.6 | +105 | high |
| cytochrome C (horse heart) | 12,359.1 ± 1.7 | 12,360.9 | −145 | high |
| ribonuclease A (bovine pancreas) | 13,678.0 ± 2.8 | 13,682.3 | −314 | low |
| | 13,776.0 ± 1.6[e] | | | low |
| | 13,876.6 ± 0.9[e] | | | low |
| lysozyme (chicken egg) | 14,308.2 ± 4.2 | 14,305.2 | +210 | medium |
| apomyogloblin (equine skeletal | calibrant | 16,950.5 | — | high |

TABLE 1-continued

COMPARISON OF EXPERIMENTALLY OBSERVED AND CALCULATED MOLECULAR MASSES (MM) OF THE THIRTEEN PROTEINS INVESTIGATED

| Protein | Observed MM | Calculated[a] MM | Δ[b] ppm | Sensitivity[c] |
|---|---|---|---|---|
| muscle) | | | | |
| β-lactoglobulin A (bovine) | 18,364.7 ± 1.4 | 18,363.1 | +87 | medium |
| trypsin inhibitor (soybean) | 20,090 ± 7<br>19,978.6 ± 0.5[f] | 20,091.1 | −50 | low<br>medium |
| trypsinogen (bovine pancreas) | 23,981.6 ± 2.0 | 23,981.1 | +21 | medium |
| subtilisin BPN' (bacillus amyloliquefaciens) | 27,327 ± 7 | 27,534.0 | −7600 | low |
| apolipoprotein AI (human) | 28,078.1 ± 0.8 | 28,078.6 | −18 | high |
| carbonic anhydrase II (bovine) | 29,021.8 ± 1.3 | 29,021.3 | +17 | high |
| albumin (bovine) | 66,509 ± 23 | 66,267 | +3650 | low |
| conalbumin (turkey egg) | 77,563 ± 23 | g | — | low |

[a]Molecular masses are calculated using the sequences compiled in the Dayhoff Protein Sequence Database and the currently accepted IUPAC values for the isotopically averaged atomic masses.
[b]Difference between the observed (column 2) and the calculated molecular mass (column 3).
[c]The sensitivity scale is: high, 0.5–10 pmol/experiment; medium, 10–50 pmol/experiment; low, weak intensity even when a higher sample amount was used.
[d]The error given is the standard deviation of the multiple determinations of the molecular mass.
[e]Ion species of unknown origin related to ribonuclease A (see text).

TABLE 2

EXPERIMENTALLY OBSERVED MOLECULAR MASSES FROM APOLIPOPROTEIN AI IONS HAVING DIFFERENT NUMBER OF ATTACHED PROTONS (z)

| z | Observed m/z | Molecular Mass u | Δ[a] |
|---|---|---|---|
| 36 | 780.95 | 28077.9 | −0.7 |
| 35 | 803.25 | 28078.5 | −0.1 |
| 34 | 826.85 | 28078.6 | +0.0 |
| 33 | 851.87 | 28078.5 | −0.1 |
| 32 | 878.45 | 28078.2 | −0.4 |
| 31 | 906.80 | 28079.6 | +1.0 |
| 30 | 936.90 | 28076.8 | −1.8 |
| 29 | 969.18 | 28077.0 | −1.6 |
| 28 | 1003.8 | Mean = 28078.2 / 28078.1 ± 0.8 | −0.4 |

[a]Difference between the observed (column 3) and the calculated average molecular mass (28078.6 u) of apolipoprotein AI.

What is claimed is:

1. A system for the analysis of the mass spectra of ions comprising;

(a) a mass analyzer having an inlet orifice means to receive ions to be analyzed (b) an electrospray ion source connected to said mass analyzer and including;

(i) electrospray means to transport a dilute solution of the molecules of interest and to spray charged micron size droplets of the solution;

(ii) means to impose a voltage of about 1–10 KV on said electrospray means;

(iii) a capillary tube having an entrance orifice positioned across a gap from said electrospray means to receive said charged droplets, said capillary tube having an exit orifice; and said gap being without a counterflow of gas therein;

(iv) means to impose a voltage on said capillary tube;

(v) means to heat said capillary tube;

(vi) a skimmer means to focus the ions and having an inlet and an outlet side and an orifice electrically isolated from the capillary tube, said skimmer means orifice being positioned at a distance from the capillary tube exit orifice;

(vii) a first vacuum chamber enclosing the capillary tube exit orifice and the skimmer orifice and first means to create a vacuum therein;

(viii) a second vacuum chamber enclosing the outlet side of the skimmer and the inlet orifice of the spectrometer and second means to create a vacuum therein,

2. A system as in claim 1 wherein said mass analyzer is a quadrupole mass analyzer.

3. A system as in claim 1 wherein said electrospray means includes a syringe needle tube through which the solution is pumped.

4. A system as in claim 1 wherein voltage imposed on the electrospray means is in the range of about 1–10 KV.

5. A system as in claim 3 wherein the syringe needle has an exit orifice which is positioned in the range of about 0.5 to 4 cm. from the entrance orifice of the capillary tube.

6. A system as in claim 1 wherein said capillary tube is a metal tube.

7. A system as in claim 1 wherein said capillary tube is in the range of about 1 cm to 300 cm in length.

8. A system as in claim 7 wherein said capillary tube is in the range of 1–300 mm in length.

9. A system as in claim 1 wherein said means to impose a voltage on the capillary tube imposes a voltage of about 0–1000 V.

10. A system as in claim 9 wherein said means to impose a voltage on the capillary tube imposes a voltage of about 100–300 V.

11. A system as in claim 1 wherein said means to heat the capillary tube is an electrical resistance wire wound around said capillary tube.

12. A system as in claim 1 wherein said capillary tube is a metal tube and the means to heat said tube utilizes the resistance of said tube as the heating element.

13. A system as in claim 1 wherein said first vacuum means creates vacuum in the range of about 0.1 to 50 torr.

14. A system as in claim 1 wherein said second vacuum means creates a vacuum in the range of about $1\times10^{-3}$ to $1\times10^{-6}$ torr.

15. A system as in claim 1 wherein the means to heat the capillary tube heats said tube in the range of about 25°-200° C.

16. A system as in claim 15 wherein the means to heat the capillary tube heats said tube in the range of about 80°-90° C.

17. A system as in claim 1 wherein the capillary tube exit orifice is positioned in the range of about 1-10 mm from the skimmer means orifice.

18. A system as in claim 1 wherein said gap is in the range of about 0.5-5cm.

19. A system as in claim 1 wherein said gap is in the laboratory atmosphere so that the spray may be viewed and adjusted.

20. A system as in claim 1 wherein said gap is in a gas controlled atmosphere.

21. A system for the analysis of the mass spectra of ions comprising an electrospray ion source adapted to be connected to a mass analyzer and including;

(i) electrospray means including a syringe needle to transport a dilute solution of the molecules of interest and to spray charged micron size droplets of the solution; means to pump said solution through said syringe needle;

(ii) means to impose a voltage of about 1-10 KV on said electrospray syringe needle;

(iii) an elongated metal capillary tube and having an entrance orifice positioned across a gap from said electrospray means to receive said charged droplets, said capillary tube having an exit orifice; said gap being in the atmosphere and being about 0.5-4cm in width; said gap being without a counterflow of gas therein;

(iv) means to impose a voltage of 100-300 V on said capillary tube and means operable by the user to vary said voltage within said range;

(v) means to heat said capillary tube in the range of about 80°-90° C.;

(vi) a skimmer means to focus the ions and having an inlet and an outlet side and an orifice electrically isolated from the capillary tube, said skimmer means orifice being positioned at a distance from the capillary tube exit orifice;

(vii) a first vacuum chamber enclosing the capillary tube exit orifice and the skimmer orifice and first means to create a vacuum therein.

(viii) a second vacuum chamber enclosing the outlet side of the skimmer and the inlet orifice of the spectrometer and second means to create a vacuum therein which is a greater vacuum then the vacuum of said first vacuum chamber.

22. A system as in claim 21 wherein said means to heat the capillary tube is selected from the group consisting of an electrical resistance wire wound around said capillary tube and the electrical resistance of the tube.

23. A system as in claim 21 wherein said first vacuum means creates a vacuum in the range of about 0.1 to 50 torr.

24. A system as in claim 21 wherein said second vacuum means creates a vacuum in the range of about $1\times10^{-3}$ to $1\times10^{-6}$ torr.

25. A system as in claim 21 wherein the capillary tube exit orifice is positioned in the range of about 1-10mm from the skimmer means orifice.

26. A system as in claim 21 wherein said gap is in the range of about 0.5-4cm.

* * * * *